US005720085A

United States Patent [19]

Bernard

[11] Patent Number: 5,720,085

[45] Date of Patent: Feb. 24, 1998

[54] ARRANGEMENT FOR THE FASTENING OF A WRISTLET ONTO A WRIST-WATCH

[75] Inventor: Christophe Bernard, Morteau, France

[73] Assignee: Jacques Benedict, Saint Cloud, France

[21] Appl. No.: 783,989

[22] Filed: Jan. 15, 1997

[30] Foreign Application Priority Data

Jan. 15, 1996 [FR] France ..... 96 00371

[51] Int. Cl.[6] ..... A44C 5/00

[52] U.S. Cl. ..... 24/265 WS; 24/68 J; 24/71 J

[58] Field of Search ..... 24/265 WS, 68 J, 24/69 J, 70 J, 71 J, 71 R, 71 T, 685

[56] References Cited

U.S. PATENT DOCUMENTS

| | | | |
|---|---|---|---|
| 2,820,275 | 1/1958 | Lancaster | 24/265 WS |
| 3,612,365 | 10/1971 | Dintsman | 24/265 WS |
| 4,432,476 | 2/1984 | Yokosuka | 24/265 WS |
| 5,175,912 | 1/1993 | Chevalley et al. | 24/68 J |

FOREIGN PATENT DOCUMENTS

| | | |
|---|---|---|
| 2 602 648 | 2/1988 | France . |
| 2 694 484 | 2/1994 | France . |
| 58-28681 | 2/1983 | Japan . |
| 647 379 | 1/1985 | Switzerland . |

*Primary Examiner*—Victor N. Sakran
*Attorney, Agent, or Firm*—Pennie & Edmonds LLP

[57] ABSTRACT

An arrangement for fastening a wristlet onto a watch the middle-case of which is provided on its lateral sides with case-flanks to support lugs for the fastening of the wristlet and formed with holes for the axial engagement of the ends of the lugs and wherein at least one flank is movably mounted with respect to the case so that it may perform a movement for disengaging the lugs from their engagement holes and a pivoting movement into a position in which the ends of the lugs are remote enough from the flank formed with their engagement holes in order to permit the withdrawal of the ends of the wristlet from the lugs by a translational movement in the axial direction of the lugs.

6 Claims, 2 Drawing Sheets

ARRANGEMENT FOR THE FASTENING OF A WRISTLET ONTO A WRIST-WATCH

TECHNICAL FIELD

The invention relates to an arrangement for the fastening of a wristlet onto a wrist-watch, of the type comprising a case comprising at each one of its sides adjacent to the wristlet, a bar or lug onto which is secured the corresponding end of the wristlet shaped so as to form a loop of general tubular shape surrounding the bar or lug.

BACKGROUND ART

Fastening arrangements of this kind are already known. They however exhibit the major inconvenience that both lugs or bars for the fastening of the wristlets are permanently set into supporting elements mounted onto the case so that changing the wristlet requires the opening of the loop thereby requiring the use of a tool, knife or small screw-driver. This operation is rather difficult and long.

SUMMARY OF THE INVENTION

The object of the present invention is to provide an arrangement for the fastening of w wristlet onto a wrist-watch which would cope with the inconvenience of the known arrangements which has just been stated.

For that purpose the arrangement according to the invention is characterized in that the middle case is provided on its lateral sides with case flanks forming means for supporting the bars, lugs or pins for the fastening of the wristlet and formed with holes for the axial engagement of the ends of the lugs and in that at least one flank is mounted in movable relationship with respect to the case so that it may carry out a movement for disengaging the lugs from their engagement holes and a pivoting movement into a position in which the ends of the lugs are remote from the flanks formed with their holes in order to allow the withdrawal of the end of a wristlet from its fastening bar or lug by a translational movement of the wristlet in the direction of the bar or lug.

According to one embodiment of the invention, one side flank of the case carries both lugs whereas both holes for the engagement of the lugs are formed in the other flank and the lugs carrying flank is mounted in movable relationship onto the lateral side of the case so that it may accomplish a motion away from the case with a view to disengage the lugs from their holes and a pivoting motion for withdrawing the ends of the wristlet.

According to another embodiment of the invention, each flank carries at one end a fastening lug and at its other end the hole for the engagement of the lug carried by the other flank and each flank is mounted on its lateral side of the case so as to perform a motion away from the case with a view to remove its lug from the hole provided in the other flank and a pivoting movement for the withdrawal of the corresponding end of the wristlet.

According to an advantageous characteristic feature of the invention, each flank carrying at least one lug is pivotally mounted about a pin of a link which is provided with two links parallel to each other and to the edge of the case, the first pin forming the pivot pin of the flank and a second pin forming the pivot pin of the link onto the case and both pins are spaced from each other so that the swinging about the second pin constitutes the aforesaid moving away providing the disengagement of the lug from its engagement hole and the swinging about the first pin constitutes the pivoting movement with a view to remove the end of the wristlet.

BRIEF DESCRIPTION OF THE DRAWINGS

The invention will be better understood and further objects, characterising features, details and advantages thereof will appear more clearly as the following explanatory description proceeds with reference to the accompanying diagrammatic drawings given by way of non limiting examples only illustrating several embodiments of the invention and in which.

DETAILED DESCRIPTION OF THE PREFERRED EMBODIMENT

Figure 1:
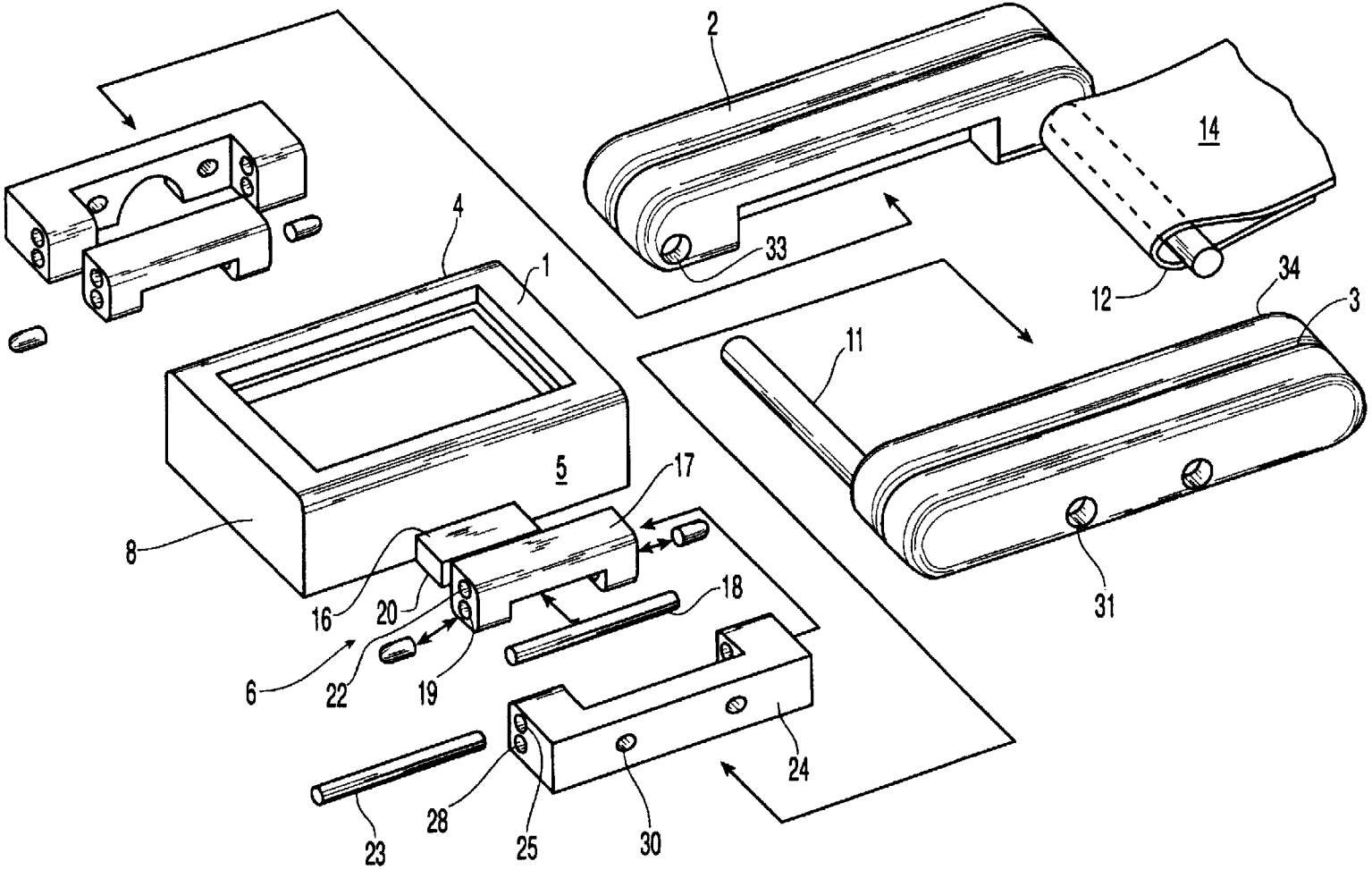
FIG. 1 is an exploded perspective view of a first embodiment of the present invention.

FIG. 1 shows an exploded perspective view of the essential elements which form the arrangement for the fastening of a wristlet onto a wrist-watch, of which only the middle-case 1 is shown.

The fastening arrangement essentially comprises two case flanks 2, 3 mounted onto the lateral sides 4, 5 respectively, of the middle-case 1 through the medium of a device 6. Both blanks 2 and 3 extend in parallel relation to the edges 4 and 5 and project beyond the opposite front and rear faces 8 and 9 of the middle-case 1 so that the lugs 11 and 12 extend respectively forward of and behind the middle at some distance from the opposite front and rear faces 8 and 9. As diagrammatically shown, each lug 11 forms the means for fastening one end of the wristlet 14. Each wristlet end has a generally tubular shape which is engaged inside thereof by a lug 11 or 12.

Both devices 6 for mounting the lateral flanks 2 and 3 onto the middle 1 exhibit the same structure. Thus, the device associated with the flank 2 comprises a bracket-shaped element 16 which projects in perpendicular relation to and from the side face 5, a U-shaped link-like part 17 which is pivotally connected with its legs onto the bracket 16 for swinging motion about a lower pin 18 which is inserted into aligned holes 19, 20 of the link 17 and of the bracket 16, respectively. The link 17 comprises another hole 21 which extends in parallel relation to the hole 19 and is intended to receive an upper pin 23 permitting the pivotal connection of a part 24 onto the link 17. The part 24 is U-shaped, the cut-out part 25 being adapted to receive the link 17. The legs of the part 24 exhibit upper holes 25 for accommodating the ends of the pin 23. The part 24 further comprises lower holes 26 below the holes 25 also formed in the legs of the part 24, which permit the positioning of a retaining ball catch, holding dog or stop-pawl known per se and which forms a safety means as described subsequently. Each retaining ball catch engages with its spring body the outer portion of the lower hole 19 of the link 17 whereas the ball of the retaining catch is intended to engage the opening of a bore 28 located in the internal face of the corresponding leg of the part 24. The insertion of the ball into this bore opening under the effect of the pressure of the spring of the retaining catch provides for the holding of the part 24 onto the link 17 until the application of pivot force which allows to overcome the return force of the ball by pushing the latter back into the outer portion of the bore 19. The part 24 forms the support for one of the two case flanks 2 or 3. The flank will be secured onto the part for example with the assistance of screws of which the holes only are shown at 30 and 31, respectively.

In the embodiment shown on FIG. 1, each case flank carries a lug 11 or 12. In the assembled position of the arrangement in which both flanks 2 and 3 are applied upon the side faces 4 and 5 of the middle-case 1, the end of each lug 11, 12 engages one hole 33, 34, respectively, which is formed in the projecting portion of the other case flank. This hole exhibits a conical shape extending in widening relationship in the direction towards the outside. The hole 33, 34 could also have an oblong shape in the direction perpendicular to the pivot pins 18, 23.

Figure 2:
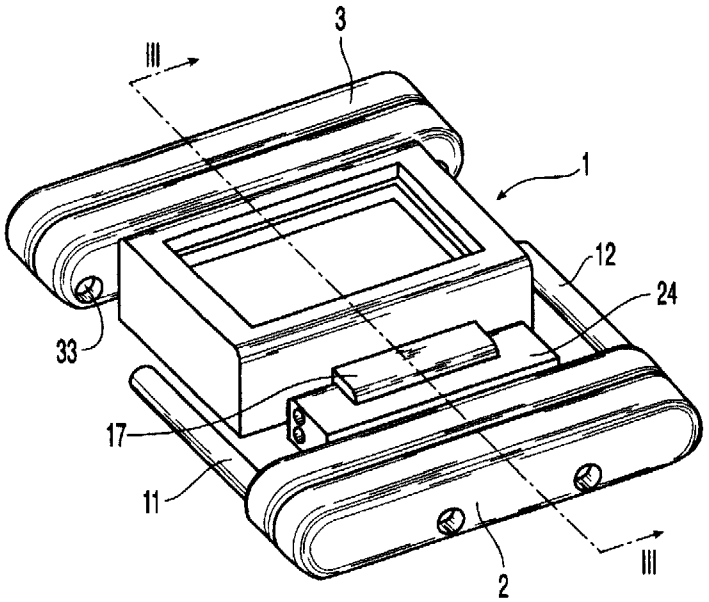
FIG. 2 is an exploded perspective view of a second embodiment of the invention.

In the embodiment according to FIG. 2, both lugs 11 and 12 could be carried by one of the two case flanks 2 or 3, the other one then comprising both engagement holes 33 and 34. In this case it suffices that the flank carrying the lugs be mounted in movable relationship onto the middle 1, whereas the other flank may be mounted in stationary relationship.

In a third embodiment of the invention with a simpler structure, the part 24 for supporting one case-flank 2 or 3 carrying the lugs 11 and 12 could be pivotally mounted onto the bracket 16 for example by means of the pin 18. In this case, the tapered holes 33, 34 will be replaced with a groove which opens into the real front face of the flank so that during the pivoting of the part 24 together with the flank, the ends of the lugs 11 and 12 may become disengaged from the flank into which they are inserted in the assembled position of the arrangement.

Figure 3:
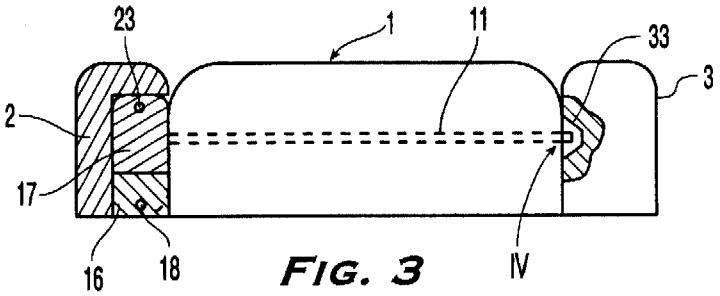
FIGS. 3 to 5 are diagrammatic views in section taken upon the line III—III of FIG. 2 and showing the arrangement according to the invention in three different characteristic positions, respectively.
Figure 4:
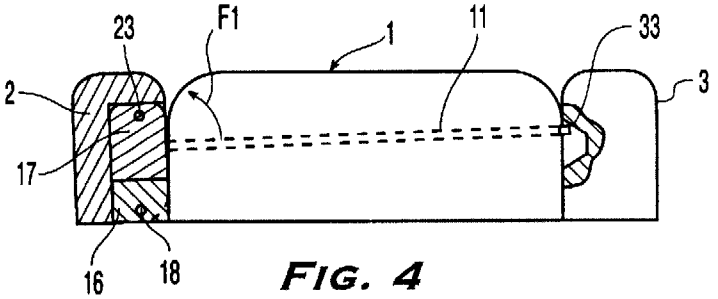
Figure 5:
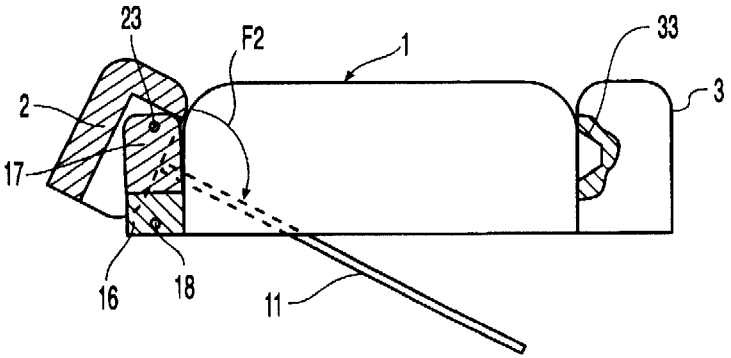

Referring to FIGS. 3 to 5, the operation of the arrangement which has just been described and is shown on the figures will be described hereinafter.

FIG. 3 shows the arrangement in its assembled position in which both lugs 11, 12 are engaging with their free ends in their engagement holes 33, 34. In this position the wristlet is locked onto the lugs 11 and 12. When it is desired to replace the wristlet with another one, one causes at first the lug 17 to pivot about the lower pin 18 in the direction of the arrow F1 as shown on FIG. 4. The depth of penetration of the ends of the lugs 11 and 12 into the tapered or oblong holes 33 and 34 and the sizes of the holes are selected in such a manner that the ends be moved out of their engagement holes at the end of this first pivoting movement.

After the disengagement of the ends of the lugs 11 and 12, one causes the flank supporting part or parts 24 (according as both lugs 11 and 12 are carried by the same flank or by both flanks) to pivot in the direction of the arrow F2 about the upper pin 23 in the position shown on FIG. 5. This pivoting allows to move the ends of the lugs 11 and 12 sufficiently away from the other flank in order that the wristlet may be disengaged from the lugs by a translational motion. The wristlet could then be replaced with another one and the operating steps which have just been described would be performed in the reverse order until the arrangement assumes again its position shown on FIG. 3*a*.

To avoid that the process of disengagement of the wristlet occurs accidentally, the retaining ball catches are given such dimensions that the force necessary for releasing the pivoting motion for disengaging the lugs from their holes be above a predetermined threshold.

As to the third embodiment of the invention which only provides the pivoting of the part 24 about the pin 18 inserted into the bracket 16, by omitting the link 17, it is also possible to provide retaining ball catches then disposed in a pair of suitable mutually confronting holes formed in both parts 24 and 16 in direct engagement with each other.

Multiple modifications may of course be made to the arrangement which has just been described without departing from the scope of the invention. Thus, the shapes of the different parts may be chosen differently provided that their functions be preserved. The safety device could of course have any other known shape.

What is claimed is:

1. An arrangement for fasting a wristlet onto a wrist-watch, of the type comprising a case comprising at one of its ends adjacent to the wristlet, a lug onto which is fastened the corresponding end of the wristlet, shaped so as to form a loop of general tubular shape surrounding the lug, wherein the improvement consists in that the middle-case of the wrist-watch is provided on its lateral sides with case flanks forming means for supporting the fastening lugs of the wristlet and provided with holes for the axial engagement of the free ends of the lugs and in that one flank carrying at least one lug is mounted in movable relationship with respect to the case so that it carry out a movement for disengaging the lug from its engagement hole provided in the other flank and a pivoting movement in a position in which the end of the lug is remote from the flank provided with the hole in order to allow the withdrawal of the end of the wristlet from its fastening lug by a translational motion of the wristlet in the axial direction of the lug.

2. A fastening arrangement according to claim 1, wherein one case-flank carries both lugs whereas both engagement holes are provided in the other flank and the lugs carrying flank is movably mounted onto the lateral side of the case so that it may accomplish a movement away from the case with a view to disengage the lugs from their holes and a pivoting movement for withdrawing the ends of the wristlet.

3. A fastening arrangement according to claim 1, wherein each case-flank carries at one end one fastening lug and comprises at its other end the hole for the engagement of the lug carried by the other flank and each flank is mounted onto its lateral side of the case so that it may carry out a movement away from the case with a view to disengage its lug from the hole provided in the other flank and a pivoting movement for withdrawing the corresponding end of the wristlet.

4. A fastening arrangement according to claim 3, wherein each flank carrying at least one lug is pivotally mounted about a first pin of a link which is provided with a second pin parallel to the first one and to the edge of the case and constituting a pivot pin for the link onto the case and wherein both pins are spaced from each other so that the pivoting about the second pin constitutes the aforesaid movement away providing for the aforesaid disengagement and the pivoting about the first pin constitutes the pivoting movement with a view to withdraw the end of the wristlet.

5. A fastening arrangement according to claim 1, wherein the holes for the engagement of the lugs exhibit a tapered shape extending in widening relationship outwards or an oblong shape so that during the disengagement of the lugs, the ends of the latter become disengaged from the holes.

6. A fastening arrangement according to claim 1, wherein one case-flank carrying at least one lug is pivotally mounted onto the middle-case about a pin forming the axis of the movement of disengagement and the axis of the pivoting movement and wherein the engagement hole is opened sidewise.

* * * * *